US010477639B2

(12) United States Patent
Pilat et al.

(10) Patent No.: US 10,477,639 B2
(45) Date of Patent: Nov. 12, 2019

(54) ROOM LAMP

(71) Applicant: Luke Roberts GmbH, Vienna (AT)

(72) Inventors: Lukas Pilat, Vienna (AT); Robert Kopka, Vienna (AT); Martin Dijango, München (DE)

(73) Assignee: Luke Roberts GmbH, Wein (AT)

( * ) Notice: Subject to any disclaimer, the term of this patent is extended or adjusted under 35 U.S.C. 154(b) by 0 days.

(21) Appl. No.: 15/750,304

(22) PCT Filed: Aug. 3, 2016

(86) PCT No.: PCT/IB2016/054671
§ 371 (c)(1),
(2) Date: Feb. 5, 2018

(87) PCT Pub. No.: WO2017/021898
PCT Pub. Date: Feb. 9, 2017

(65) Prior Publication Data

US 2018/0220508 A1 Aug. 2, 2018

(30) Foreign Application Priority Data

Aug. 5, 2015 (DE) ..... 10 2015 112 848

(51) Int. Cl.
*H05B 33/08* (2006.01)
*F21V 5/00* (2018.01)
(Continued)

(52) U.S. Cl.
CPC ..... *H05B 33/0863* (2013.01); *F21S 8/061* (2013.01); *F21V 5/007* (2013.01);
(Continued)

(58) Field of Classification Search
CPC ..... H05B 33/0863; F21V 23/003; F21V 23/0492; F21V 23/0464; F21V 23/045;
(Continued)

(56) References Cited

U.S. PATENT DOCUMENTS

2009/0310035 A1 12/2009 Laporte
2012/0319616 A1 12/2012 Quilici et al.
(Continued)

FOREIGN PATENT DOCUMENTS

EP 1 434 277 A1 6/2004
EP 2 518 398 A2 10/2012
(Continued)

*Primary Examiner* — Dedei K Hammond
*Assistant Examiner* — Raymond R Chai
(74) *Attorney, Agent, or Firm* — Bryan W. Bockhop; Bockhop Intellectual Property Law, LLC

(57) ABSTRACT

The invention relates to a room lamp (1) which is designed to light a space under different angles and in a controlled manner, and which comprises—a plurality of different light emitting elements (122); and—a first illumination body (100) with a plurality of light directing devices at each of which a light emitting element (122) is arranged, each light emitting element emitting light in a light-guiding direction. At least one light directing device (102, 104, 106, 108, 110, 112, 114) has a collimation portion (124), in which the light rays of the light emitting element (122) that is arranged in the light directing device are parallelized, and a plurality of prism portions, each of which deflects a part of the parallelized light rays (126, 128, 130). The invention also relates to a method comprising the following steps:—controlling, by way of a gesture on a touch-sensitive display screen of a portable electronic device, the size and/or color and/or brightness of at least one area to be lighted;—detecting the orientation of the portable electronic device and of the room lamp; and—transmitting to the room lamp the size and/or color and/or brightness of the area to be lighted depending on the orientation of the portable electronic device and/or of the room lamp.

17 Claims, 9 Drawing Sheets

(51) Int. Cl.

| | |
|---|---|
| ***F21V 23/04*** | (2006.01) |
| ***F21S 8/06*** | (2006.01) |
| ***F21V 5/02*** | (2006.01) |
| ***F21V 23/00*** | (2015.01) |
| *F21V 7/00* | (2006.01) |
| *F21Y 115/10* | (2016.01) |
| *F21Y 107/90* | (2016.01) |
| *F21Y 105/18* | (2016.01) |

(52) U.S. Cl.
CPC ..... *F21V 5/02* (2013.01); *F21V 23/003* (2013.01); *F21V 23/045* (2013.01); *F21V 23/0464* (2013.01); *F21V 23/0492* (2013.01); *F21V 7/0016* (2013.01); *F21Y 2105/18* (2016.08); *F21Y 2107/90* (2016.08); *F21Y 2115/10* (2016.08)

(58) Field of Classification Search
CPC ..... F21V 5/02; F21V 5/007; F21V 7/0016; F21S 8/061; F21Y 2105/18; F21Y 2107/90; F21Y 2115/10
See application file for complete search history.

(56) References Cited

U.S. PATENT DOCUMENTS

| | | | | |
|---|---|---|---|---|
| 2012/0320585 | A1 | 12/2012 | Lin et al. | |
| 2015/0084513 | A1* | 3/2015 | Anthony ..... | H05B 37/0245 315/131 |
| 2015/0131281 | A1 | 5/2015 | Romeu et al. | |
| 2015/0211708 | A1 | 7/2015 | Stavely et al. | |
| 2016/0227635 | A1* | 8/2016 | Aliakseyeu ..... | H05B 33/0863 |
| 2016/0278184 | A1* | 9/2016 | Van De Sluis .... | H05B 33/0854 |
| 2016/0345414 | A1* | 11/2016 | Nolan ..... | G08C 17/02 |
| 2018/0177023 | A1* | 6/2018 | Li ..... | H05B 33/0815 |

FOREIGN PATENT DOCUMENTS

| | | |
|---|---|---|
| JP | 2006-179387 | 6/2006 |
| WO | WO 2010/103477 A1 | 9/2010 |
| WO | WO 2012/113036 A1 | 8/2012 |

* cited by examiner

ROOM LAMP

CROSS-REFERENCE TO RELATED APPLICATION(S)

This application claims the benefit of DE Patent Application No. PCT/IB2016/054671, filed Aug. 3, 2016, the entirety of which is hereby incorporated herein by reference.

BACKGROUND OF THE INVENTION

1. Field of the Invention

The present invention relates to an improved room lamp (luminaire), particularly to a room lamp, in which the brightness, color temperature, the color of the light output, the angle of the light output and the illuminated area are freely adjustable.

2. Description of the Related Art

In the prior art lamps are known which are dimmable and their color temperature and the color of the light output are adjustable. The adjustment of the light color and the color temperature may be carried out by means of a remote control. Further, so called spots are known, whose illumination angle may be adjusted after installation.

Bulbs featuring an adjustable color temperature and/or an adjustable color of the light output require comparably much assembly space so that they are not suitable for modern room lamps. Spots exhibit the disadvantage that the angle of the light output may only be adjusted by mechanically adjusting the spot. Further, LED-based luminaries are known that still require comparably much assembly space.

EP 1 434 277 A1 relates to a ray condensation element connected with a light source and an illuminated area with wedge-like portions.

EP 2 518 398 A2 suggests adjustable and pivotable LED-groups.

An object of the invention is to create a room lamp that overcomes the above mentioned disadvantages of the state of the art.

SUMMARY OF THE INVENTION

A room lamp according to the invention which is adapted to controllably illuminate a room at different angles comprises a plurality of light emitting elements and a first illumination body with a plurality of light directing devices on which a light emitting element is arranged, whereby each light emitting element emits light into a light directing device. At least one light directing device comprises a collimation area in which the light rays of the light emitting element, which is arranged on the light directing device, are parallelized and at least one prism portion each of which redirects one part of the parallelized light rays. Due to the at least one prism portion, a very space-saving illumination body and therefore a space-saving room lamp may be achieved. Different light directing devices may have different prism portions, whereby an illumination body may emit light under different angles. By turning on, dimming and turning off light emitting elements, which are arranged at predetermined light directing devices, the angle and/or the area of light output may be varied in use. The light emitting elements may be arranged in the light directing device. Thereby, together with the light directing device and the integrated collimation portion and prism portion, a very space-saving room lamp arises.

A prism portion of a light directing device may comprise an area inclined with respect to the light rays that are parallelized by the collimation portion. The inclined area of a part of the light directing device may reflect the parallelized light. This is the case, if the angle of the inclined area is larger that the critical angle. The critical angle may be the critical angle of the Snellius' Law. The light rays pass in a medium that is optically denser than air. The light directing devices may be made of plastics, for example polymers, such as PMMA.

The inclined area of a part of the light directing devices may refract the parallelized light. The latter may be the case if the angle of the collimation portion with respect to the parallelized light rays is lower that the critical angle. By these measures the required, assembly space may be reduced.

A plurality of first light directing devices emits the light that is emitted by a first light emitting element in a first light directing device under a first angle range, a plurality of second light directing devices emits the light that is emitted by a second light emitting element into a second light directing device under a second angle range, and an optional plurality of third light directing devices emits the light that is emitted by a third light emitting element into a third light directing device under a third angle range. The room lamp according to the invention may emit light under different angles into a room, so that the desired effects for a user arise and the illumination may be optimized depending on the effective use. The light output of the room lamp may vary depending on the effective use. The light output of the room lamp may create an illumination of a dining table during a meal or an illumination of a portion of a room, for example during watching TV.

The room lamp according to the present invention may comprise an arbitrary amount of light directing devices, each of which emit the light in a predetermined angle ranges. The angle ranges of the light output of the room lamp may at least partially overlap or differ from each other.

The inclined portions of a light directing device may comprise a different angle with respect to an imaginative plain. This ensures that a light directing device may emit light over a larger angle range, whereby optical comfort for a user of the room lamp is enhanced.

The prism portions may extend over a plurality of light directing devices and the inclined portion may comprise alongside the prism portion the same angle with respect to an imaginative illumination plane. Therefore, a plurality of light directing devices emits light in a predetermined angle range, whereby the homogeneity of the light output and the spatial angle spectrum are enhanced in an axis perpendicular to the illumination area.

A plurality of prism portions and/or a plurality of light directing devices may be arranged concentrically. Thus, the comfort of the light output for a user is enhanced even further.

A plurality of light directing devices may be arranged in a line. Thereby, a room may be illuminated by the room lamp in a way that is reproducible for a user.

The inclined portions of the prism portions of a light directing device may be inclined in the same direction, especially in the same room direction. This ensures that an angle range of a light directing device is illuminated homogeneously as far as possible because multiple light sources are present which emit light under a similar angle.

The first illumination body with the plurality of light directing devices may be formed (integrally). Thereby, the illumination body may be manufactured by using an efficient manufacturing process, for example by using injection molding, an extrusion tool or the like. The light emitting element may be a LED. The light emitting element may at least partially be arranged in the light directing device. As a result of each of these measures, a particular space-saving room lamp may be created.

Light emitting elements of different color may be arranged in light directing devices whose inclined portions each comprise the same angle. Thereby, angular segments may be illuminated in different colors.

In use, the first illumination body may emit light downwards, whereby the room lamp further comprises a second illumination body which emits light upwards. The room lamp may be attached to a ceiling by means of a cable. The room lamp may be attached in any other way. A diffuser may be arranged at the first illumination body and/or the second illumination body. Thus, a homogeneous light output in the room is achieved.

The angle of a cylinder conical portion between the collimation portion and the prism portion may be inclined with respect to the parallelized light such that the cylinder conical portion becomes narrower the farther it is from the light source. This ensures that the illumination bodies may be manufactured by means of injection molding or by using an extrusion procedure.

Each light directing device may comprise one to five, or preferably two to four, or more preferably three prism portions. Two to four prism portions are a compromise between height and losses due to rounded edges.

Further, the room lamp may comprise an orientation determining device adapted for determining an orientation of the room lamp. The room lamp may further comprise a transmission device and/or a receiving device adapted for receiving a preferably wireless signal. The receiving device may control the light emitting elements in response to the received signal. Due to the orientation determining device the orientation of the room lamp may be determined with respect to the orientation of an electronic operating device. The electronic operating device may be a mobile electronic device, for example a phone, a Smartphone, a Tablet-Computer, a portable computer or the like. The mobile electronic device may comprise a build-in compass. The orientation determining device of the room lamp may also be a compass. The orientation determining device of the room lamp may alternatively or additionally determine the position of the operating device on the basis of the received signal, for example the direction, field strength or the like. This may especially be applied in case of a plurality of room lamps communicating with each other.

The position of the operating device may be determined via radio signal tracking. Further, the signal field strength may be considered as an additional source of information, if it is received by multiple optional lamps that optionally communicate with each other, for example via triangulation.

The operating device may show a representation of the room to be illuminated or a virtual area that corresponds to an ideal room. In one embodiment the room lamp may transmit an orientation to the operating device. The operating device may change the orientation of the representation of the room to be illuminated in response to the transmitted orientation, for example rotating or showing another representation.

The invention further discloses a room lamp with an orientation determining device adapted for determining an orientation of the room lamp, and a receiving device adapted for receiving a signal, whereby the receiving device controls the light emitting elements in response to the received signal. Thus, the room lamp may be as formed as described above.

The object of the invention is also achieved by a method for controlling the light output of a room lamp with the following steps. The size and/or color and/or brightness and/or at least one portion of the room to be illuminated and/or the light output angle of the room lamp is controlled via a gesture on the touch-sensitive display of an operating device, for example a portable electronic device. The orientation of the portable electronic device is recognized. The height and/or the color and/or the brightness of the portion to be illuminated and the orientation of the portable electronic device are transmitted to the room lamp. Alternatively or additionally, the orientation may be transmitted by the room lamp to the operation device. The applicant of the present invention reserves the right to claim separate protection for these aspects.

The room lamp may control the light emitting elements in response to the received size and/or the received color, and/or the received brightness for at least one portion.

At least one portion to be illuminated by the room lamp may be defined via a drawing motion on the touch-sensitive screen on a partial area corresponding to the area to be illuminated. The brightness of at least one of the portion to be illuminated by the room lamp may be more increased the longer a corresponding portion of the touch-sensitive screen is touched. The brightness of at least one of the portions to be illuminated by the room lamp may be increased the faster a corresponding portion of the touch-sensitive screen is swiped. The brightness of at least one portion to be illuminated by the room lamp may be increased the more frequently a corresponding portion of the touch-sensitive screen is touched, and/or the more frequently a corresponding portion of the touch-sensitive screen is swiped, and/or the stronger a portion is pressed.

The room lamp may be switched to full light output for a downward illumination and/or an upward illumination in response to a gesture, for example a click or a double-click on an icon on the touch-sensitive screen. The room lamp may be switched to full light output for a downward illumination and/or for an upward illumination in response to a double-click on an icon on the touch-sensitive screen. The brightness of the downward illumination and/or the brightness of the upward illumination may be varied in response to shifting an icon on the touch-sensitive screen, for example by increasing or reducing the brightness of all light emitting elements consistently. The brightness of the downward illumination or the upward illumination may be varied in response to a swiping gesture with one finger or with two fingers on the touch-sensitive screen.

The brightness of a portion to be illuminated is reduced after a delete icon on the touch-sensitive screen has been touched and after a drawing motion over the corresponding portion of the touch-sensitive screen that corresponds with the portion to be illuminated has been applied. The brightness of a portion to be illuminated may be reduced after a delete icon on the touch-sensitive screen has been touched, whereby the brightness of the portion to be illuminated is being reduced more strongly, the longer a corresponding portion of the touch-sensitive screen is touched subsequently. The brightness of the portion to be illuminated is reduced after a delete icon on the touch-sensitive icon has been touched, whereby the brightness of the portion to be illuminated is being reduced more strongly the faster it is swiped thereafter over a portion of the touch-sensitive screen, which corresponds with the portion to be illuminated. The brightness of a portion to be illuminated may be reduced after a delete icon on the touch-sensitive screen has been touched, whereby the brightness of the portion to be illuminated is being reduced the stronger, the more often the corresponding portion of the touch-sensitive touch-screen is touched and/or is swiped consequently.

The downward illumination and/or the upward illumination may be switched off in response to a touch and/or a double-click on an icon on the touch-sensitive screen.

The color temperature of the light output of the room lamp may be selected by marking a point on a two-dimensional representation of possible color temperatures. The color of the light output of at least one portion of the room lamp may be selected by marking a point on a two-dimensional representation of possible colors. The light output of the room lamp may be altered in response to an external event. The external event may be an electronic message, for example a text message, an e-mail or a warning message of a warning service. The light output of the room lamp may be altered in response to the time of day, for example the light output may be altered in relation to a sunrise, a sunset and/or as a wake-up function and/or as a sleep function. The light output of the room lamp may be altered in relation to an external parameter, for example light, sound, the recognition of persons, for example via an optical sensor or the like.

The method may comprise the step of rotating of a representation of the portion to be illuminated in response to an orientation and/or an alteration of the orientation of the portable electronic device and/or room lamp. The representation of the portion to be illuminated may be a representation of the room and/or of a virtual room and/or of an ideal room.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
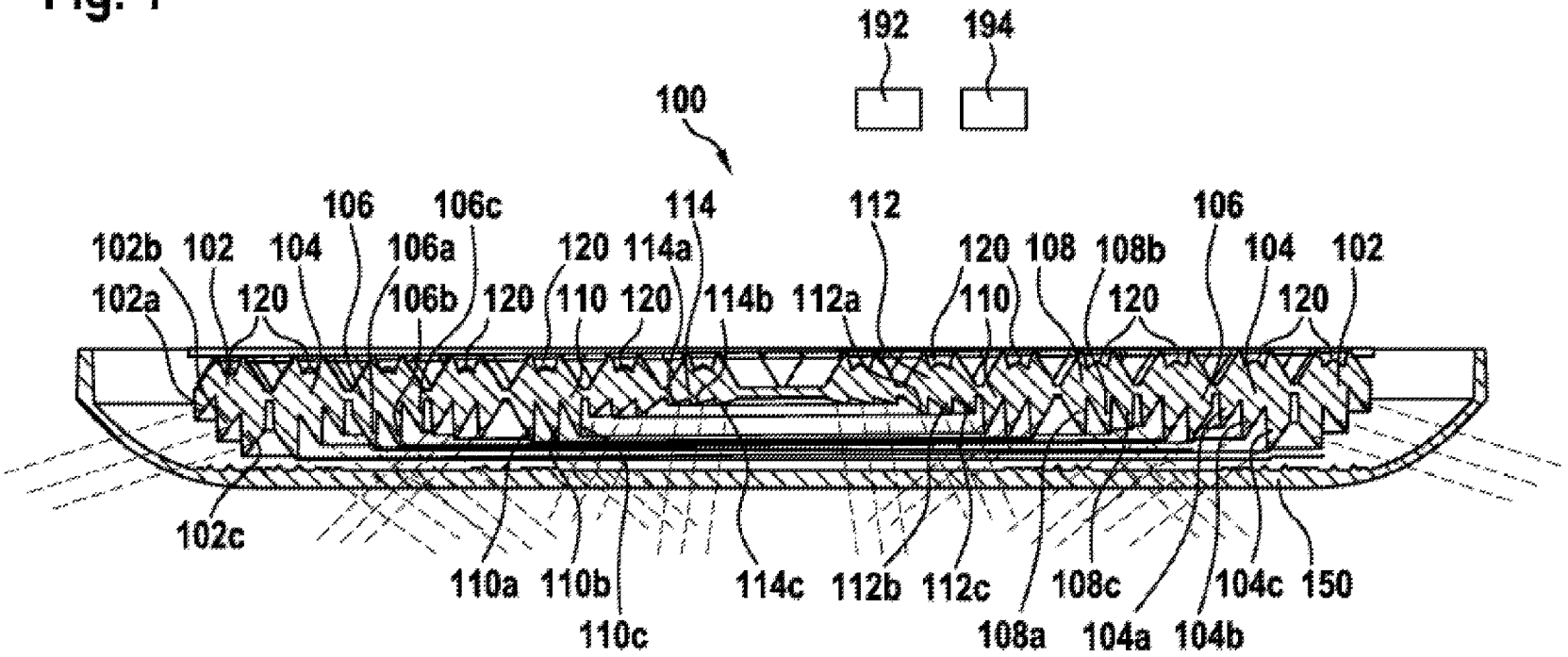
FIG. 1 shows a cross sectional view of the first illumination body.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 2:
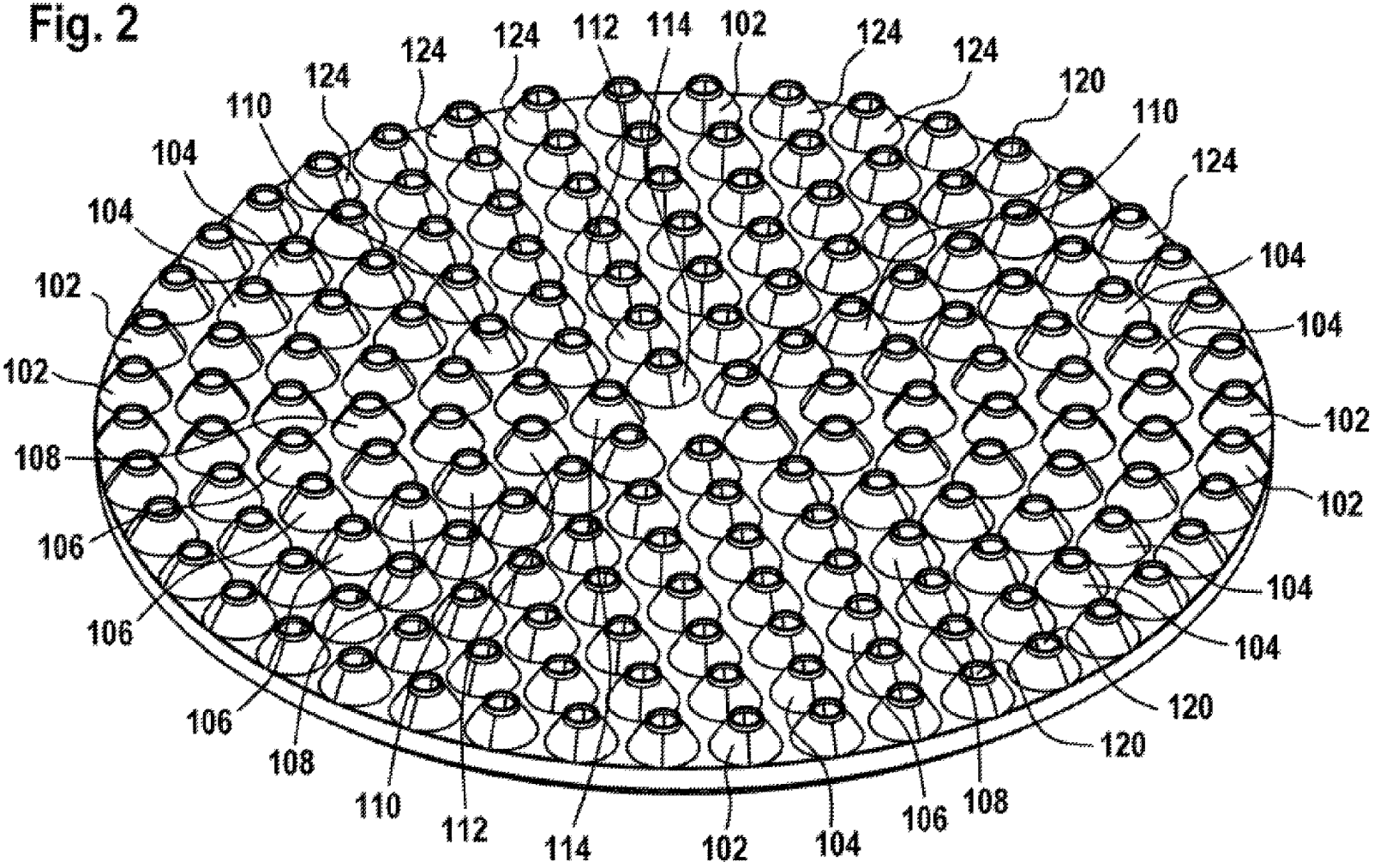
FIG. 2 shows a perspective top view of the first illumination body.
Figure 3:
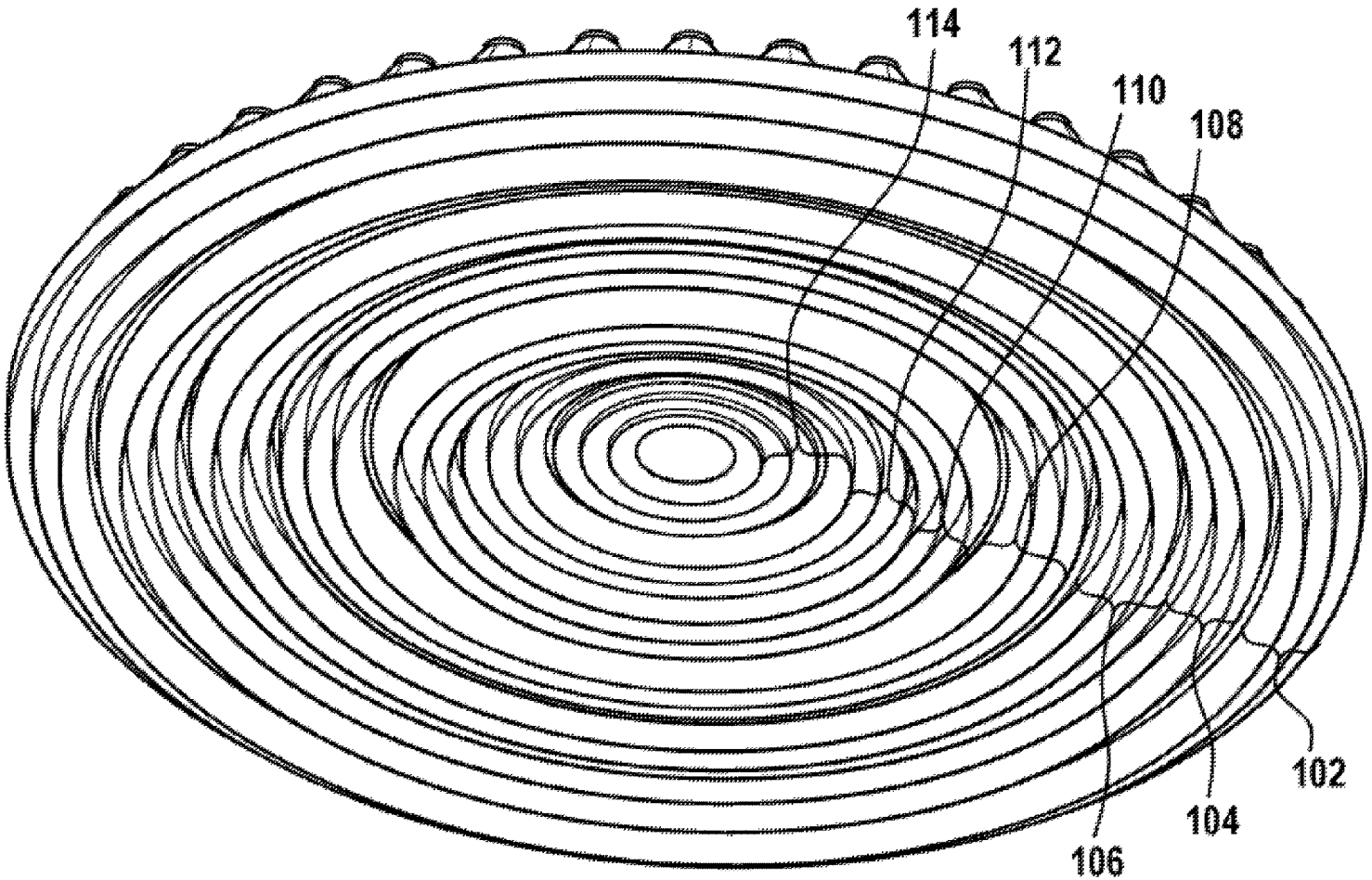
FIG. 3 shows a perspective top view of the first illumination body at the side of the light output.
Figure 4:
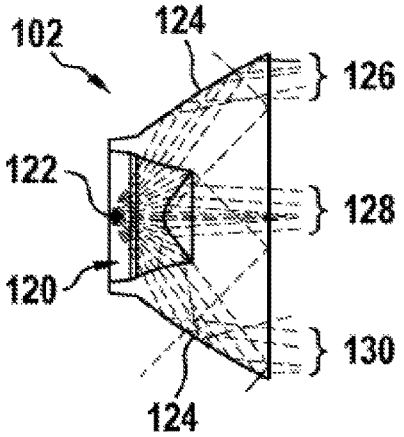
FIG. 4 shows a cross sectional view of a collimation portion of the first illumination body.
Figure 5:
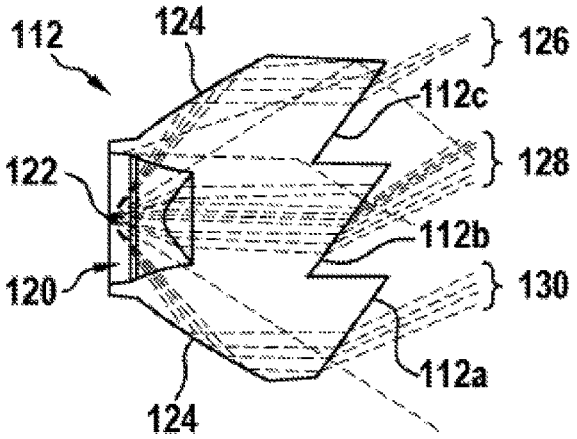
FIG. 5 shows a cross sectional view of a light directing device in which the light rays are deflected upon leaving a prism portion.
Figure 6:
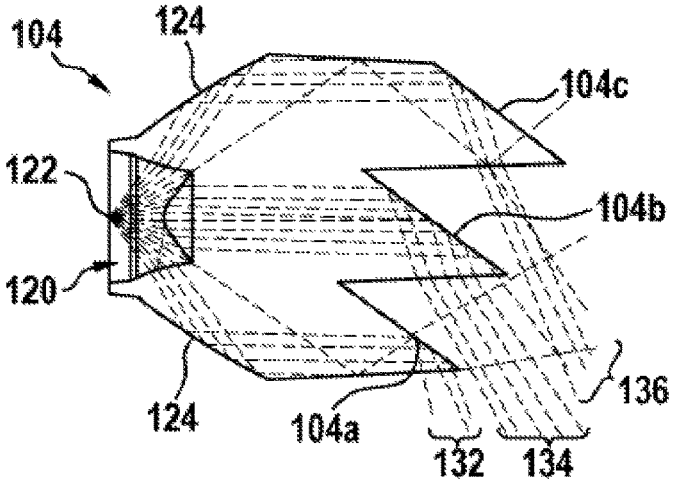
FIG. 6 shows a cross sectional view of a light directing device in which the light rays are reflected by a prism portion.
Figure 7:
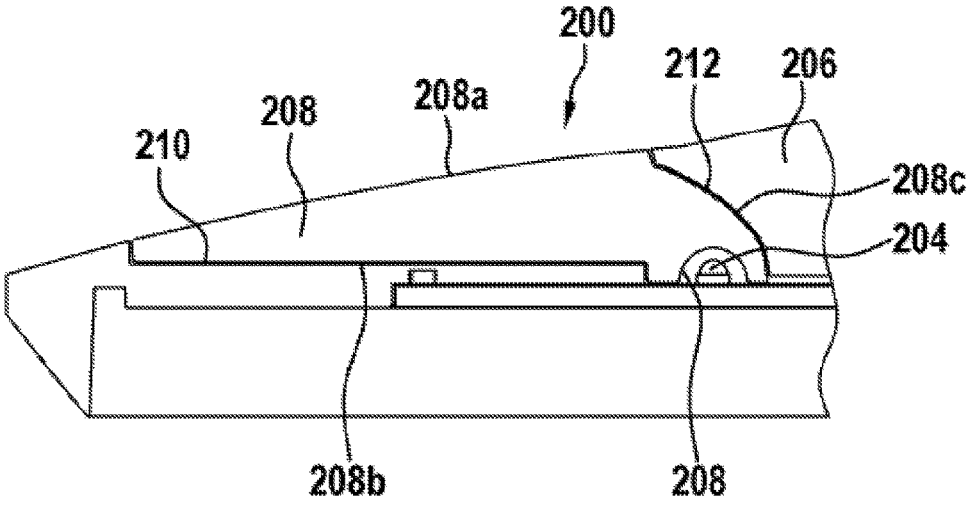
FIG. 7 shows a cross sectional view of a second illumination body.

With reference to FIGS. 1 to 6, a first illumination body with a plurality of light directing devices 102, 104, 106, 108, 110, 112, 114 is described. As shown in FIGS. 1 to 3, six first light directing devices 114 are arranged in a first inner circle. The first light directing devices 114 comprise a recess 120 where one light-emitting diode 122 is arranged, as can be seen in FIGS. 4 to 6. The light of the light-emitting diode 122 enters the first light directing device, the function of which is referred below, and exits at the three prism portions 114*a*, 114*b*, 114*c* via deflection on the inclined areas of the prism portion under a relatively steep angle in a first angle range of about −10° to about 20°. The light exiting the first light directing device 114 is dispersed for homogenization by a diffuser 150. Further, unwanted light rays that arise, for example due to an optical imperfection of the used components, are dispersed and weakened. For simplification of the representation, the dispersion by the diffuser 150 is not shown in the figures.

A plurality of second light directing devices 112 is arranged concentrically around the plurality of the first light directing devices 114. The light exits at the inclined areas of the prism portions 112*a*, 112*b*, 112*c* in a second angle range of about 0° to about 40°, and is therefore deflected more strongly than the light output of the first light directing devices 114. Hereinafter, the operating principle of the second light directing devices 112 is described in more detail under reference of FIG. 5.

A plurality of third light directing devices 110 is arranged concentrically around the plurality of second light directing devices 112. The light that is directed via a light-emitting diode into the recess 120 is reflected on the inclined areas of the prismatic portions 110*a*, 110*b*, 110*c* and exits at the prism portions in a third angle range that is flatter than the second angle range, and is dispersed and homogenized in the diffuser 150. The third angle range is about 10° to 60°. The third angle range is directed into a different direction than the first angle range, the second angle range and the fourth angle range described below.

A plurality of fourth light directing devices 108 is arranged concentrically around the plurality of the third light directing devices 110. The light of one light-emitting diode 122 enters the fourth light emitting device 108 via the recess 120 and is reflected at the inclined areas of the prism portions 108*a*, 108*b*, 108*c*, before it exits the prism portion under a fourth angle range of about 20° to about 70° and is dispersed and homogenized by the diffuser 150.

A plurality of fifth light directing devices 106 is arranged concentrically around the plurality of fourth light directing devices 108. The light of a light-emitting diode enters the fifth light directing device 106 via the recess 120 and is reflected at the inclined areas of the prism portions 106*a*, 106*b*, 106*c*, before it exits the prism portion under a fifth angle range of about 30° to about 80° which is flatter than the fourth angle range, and is dispersed and homogenized by the diffuser subsequently.

A plurality of sixth light directing devices 104 is arranged concentrically around the plurality of fifth light directing devices 106. The light of a light-emitting diode 122 enters the sixth light directing device 104 via the recess 120 and is reflected at the inclined areas of the prism portions 104*a*, 104*b*, 104*c*, before it exits the prism portion under a sixth angle range of about 35° to about 85° and is homogenized and dispersed by the diffuser subsequently.

A plurality of seventh light directing devices 102 is arranged concentrically around the plurality of sixth light directing devices 104. The light of a light-emitting diode enters the seventh light directing device 102 via the recess 120 and is reflected at the inclined areas of the prism portions 102*a*, 102*b*, 102*c*, before it exits the prism portion under a seventh angle range of about 40° to about 90°, which is flatter than the sixth angle range, of the seventh light directing device 102, before it enters the diffuser 150 for dispersion and homogenization. The third, the fifth and the sixth angle range are opposite to the first, the second, the fourth and the seventh angle range.

Under reference of FIG. 3 it can be seen that the prism portions of the first light directing device 114, the second light directing device 112, the third light directing device 110, the fourth light directing device 108, the fifth light directing device 106, the sixth light directing device 104 and the seventh light directing device 102 are arranged concentrically circumferential. The prism portions of the light directing device 102-114 are designed like Fresnel lenses.

FIG. 2 shows a perspective view of the collimation portions 124 of the light directing devices 102-114. At the end of the conical collimation portion 114 is a recess 120, in which a light-emitting diode is arranged.

The collimation portion 124 is described in more detail under reference of the sectional view of FIG. 4. The recess 120 in which the light-emitting diode 122 is arranged, is located in the collimation portion. The collimation area 124 parallelizes the light of the light-emitting diode on its conical surface into essentially three exemplary beams of rays 126, 128, 130. The collimation portion 124 and the light directing device 102-114 may be made of a transparent plastic, for example of PMMA.

With reference to FIG. 5, the operating principle of the first light directing devices 114 and the second light directing devices 112 is explained by the example of the second light directing devices 112. The light rays parallelized by the collimation portion 124 impinge the inclined areas of the three prism portions 112*a*, 112*b*, 112*c* and are refracted away from the perpendicular since the inclined areas of the prism portions 112*a*, 112*b*, 112*c* are located relative to the parallelized light rays below of the critical angle.

With reference to FIG. 6, the operation principle of the third light directing devices 110 of the fourth light directing devices 108, of the fifth light directing devices 106, of the sixth light directing devices 104 and the seventh light directing devices 102 is explained by using the example of the sixth light directing device 104. The parallelized light rays impinge the inclined areas of the prism portions 104*a*, 104*b*, and 104*c* under an angle which ranges above the critical angle. Therefore, the beams of rays 130, 132, 134 are reflected at the inclined areas of the prism portions 104*a*, 104*b*, 104*c* and exit at the inclined opposed areas of the sixth light directing device. It is to be understood that the inclined areas may be coated for reducing the losses, for example with a reflective coating. The inclined areas may comprise reflectors.

As can be seen in FIGS. 5 and 6, a cylinder cone which tapers in the direction of the prism portions 104*a*, 104*b*, 104*c*, 112*a*, 112*b*, 112*c* extends between the conical collimation area which tapers in the direction of the recess 120 and the prism portions 104*a*, 104*b*, 104*c*, 112*a*, 112*b*, 112*c*. This cylinder cone 126 is necessary so that the illumination body 100 may be manufactured via an injection molding process or by using an extrusion tool.

The inclination of the cylinder cone may be about 1° to about 2°. Thereby, it may be achieved that the deviation of an ideal cylinder only has a small influence on the quality of the light output.

In all light directing devices the inclined areas of the prism portions may comprise different inclinations to one another to achieve that each light directing device emits light under a wide angle spectrum.

Reference is made to FIGS. 7 to 10 which show a second illumination body 200. The second illumination body 200 comprises a light directing body 208 which, if viewed from the outside, comprises a convex curvature at a first portion, and is formed flat at a second portion 208*b* that is opposite to the first portion 208*a*. Next to the first portion 208*a* and the second portion 208*b* a third portion 208*c* is arranged which, if viewed from the outside, comprises a convex curvature. Opposite to the third portion 208*c* a light-emitting diode 204 is arranged in a concave recess. Below the second portion 208*b* a first reflecting area 210 is arranged. At the third portion 208*c* a second reflecting area 212 is arranged. The third portion 208*c* is arranged next to the first portion 208*a*. The term "next to" also comprises that the first portion 208*a* and the second portion 208*c* do not necessarily have to touch. In the embodiment described in FIGS. 7 to 10, the third portion 208*c* is located below the first portion 208*a*. Referring to the second portion 208*b*, the curvature of the first portion 208*a* is located in an angle range between about −5° to about −30°. Opposite of the second portion 208*b*, the curvature of the third portion 208*c* is located in an angle range of about 30° to about 60°.

Figure 8:
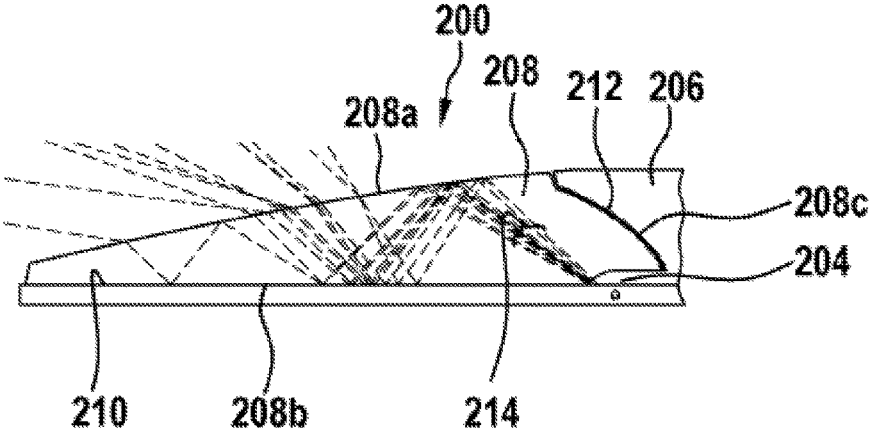
FIG. 8 shows a cross sectional view of the second illumination body under different light entrance angles.
Figure 9:
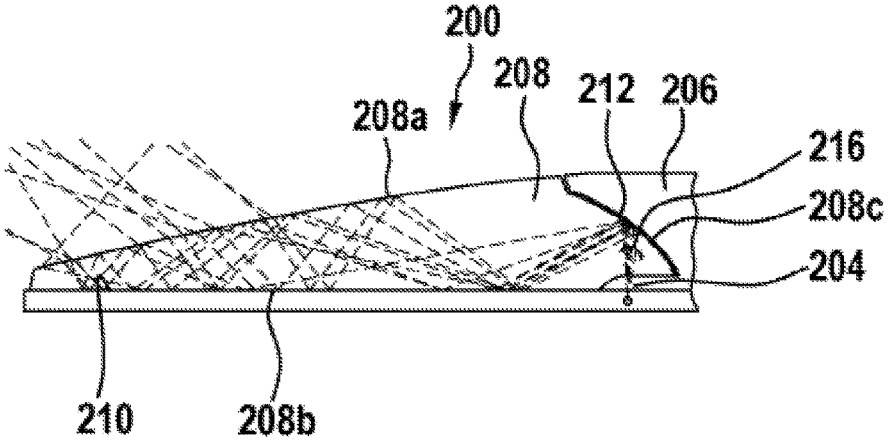
FIG. 9 shows a cross sectional view of the second illumination body under different light entrance angles.
Figure 10:
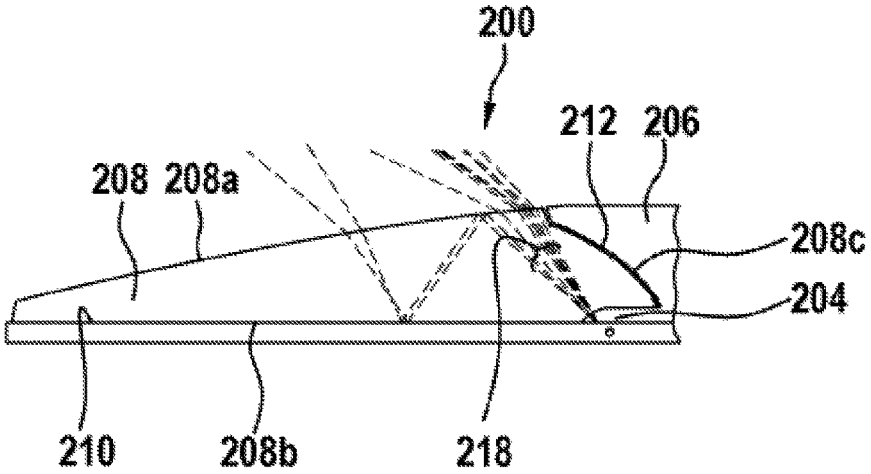
FIG. 10 shows a cross sectional view of the second illumination body under different light entrance angles.

In FIGS. 8 to 10 it can be seen that the light rays 214, 216 and 218 exiting from the light emitting diode are reflected in the first portion 208*a* and by the second portion 208*b* as long as the exit angle of the light rays is below the critical angle and the light rays exit the light directing body 208 under a flat angle. Thereby, a flat indirect illumination, such as of the ceiling, may be achieved.

In FIG. 9 it can be seen that the light rays 216 that exit the light-emitting diode 204 under an angle near the optical axis, are reflected by the second reflecting area 212 on the third portion 208*c* of the light directing body 208, and are thereby transformed into relatively flat rays within the light directing body 208, which are then reflected by the light directing body 208 and the reflective area 210 for as long as they exit the light directing body 208 at the first portion 208*a* under a flat angle which is lower than the critical angle.

The light is transmitted in the light directing body 208 as in a glass fiber due to a total reflection. As soon as the angle is low enough it exits the light directing body at the curvature 208*a* at the first portion.

The light directing body 208 may essentially be designed circularly and the plurality of second light-emitting diodes 204 may be designed circularly and/or in segments for defining the illumination areas at the second illumination body.

Figure 11:
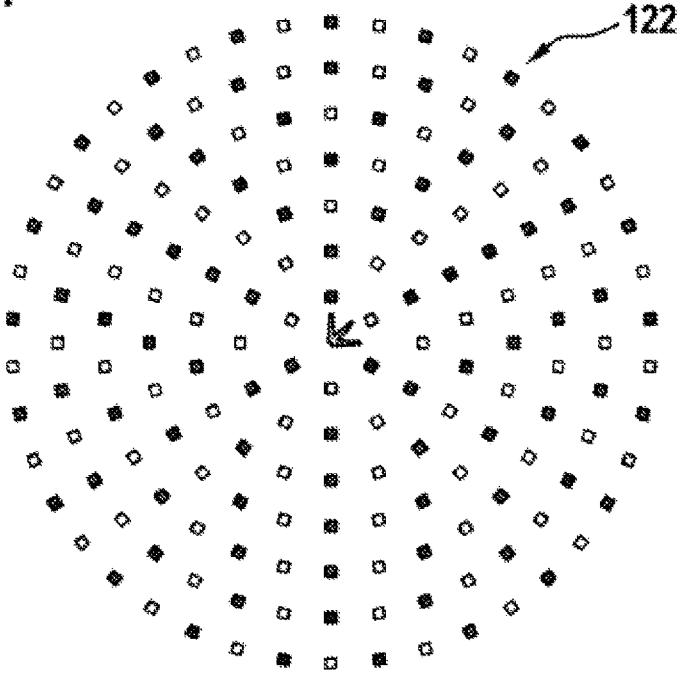
FIG. 11 shows an exemplary light-emitting diode configuration for directing light into the first illumination body.

Reference is made to FIG. 11 which shows an arrangement of first light-emitting diodes 122. The first light-emitting diodes 122 are arranged concentrically. Other patterns are possible too, for example hexagonal patterns. The light-emitting diodes 122 may be arranged in the recess 120 of the light directing devices 102-114. The light-emitting diodes are arranged concentrically in multiple circles. A circle of an arrangement of concentrically arranged light-emitting diodes 122 comprises light-emitting diodes that are associated to exactly one type of light directing devices 102-114 and that are arranged in the recess of the light directing devices. Within a circle, the light-emitting diodes may be arranged in different colors and/or in a different color temperature. The arrangement of the light-emitting diodes of different types may occur alternately or by sectors.

Figure 12:
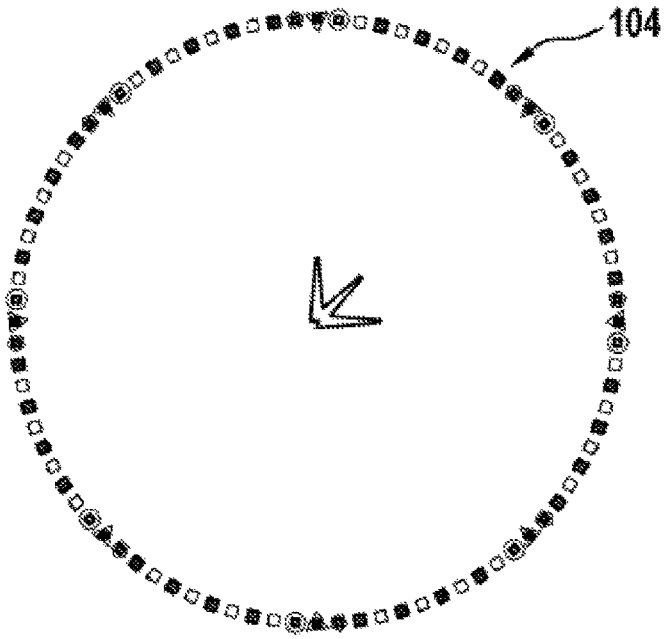
FIG. 12 shows an exemplary light-emitting diode configuration for directing light into the second illumination body.

Reference is made to FIG. 12 which comprises an arrangement of second light-emitting diodes 204 that are arranged in a circle. The second light-emitting diodes 204 are arranged at the second illumination body 200. The second light-emitting diodes 204 may emit a different color temperature and/or a different light color. The different types of light-emitting diodes 204 may be arranged by sectors.

Figure 13:
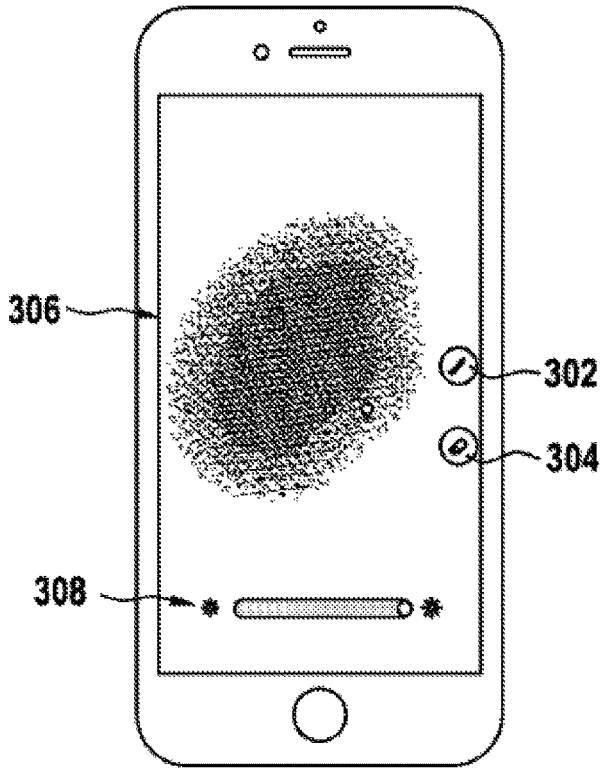
FIG. 13 shows an exemplary user interface for determining an illumination pattern.

Reference is made to FIG. 13 showing a user interface for selecting an illumination pattern of the room lamp. The user interface may be displayed on a portable electronic device, for example a mobile phone, smartphone, or a tablet computer which may comprise an orientation determining device. The portion 306 displayed in dark corresponds to a portion to be illuminated which is to be illuminated by the room lamp. The more often a user touches a spot 306 and/or an area 306 on the user interface of a touch-sensible screen, after a first icon 302 has been pressed, the brighter this portion is illuminated. Alternatively or additionally, a portion may be illuminated the brighter by the room lamp, the faster a portion 306 on the touch-sensitive screen is swiped or a portion 306 is touched. Alternatively or additionally, a portion may be illuminated the brighter, the longer and/or stronger a portion 306 of the touch-sensitive screen is touched and/or swiped.

The illumination of a portion to be illuminated may be reduced by touching a delete icon 304 and subsequently touching the portion 306 whose illumination should be reduced. The illumination may be reduced more strongly, the longer a spot 306 is touched, or the faster a portion 306 is swiped, and/or the more frequently a spot or a portion 306 is swiped. Third icons may be arranged on the user interface, by means of which the illumination of the room lamp may be switched to full power or may be switched off. Furthermore, a moveable icon 308 may be shown on the touch-sensitive screen, by means of which the illumination of the room lamp may overall be increased or reduced.

The user interface shown in FIG. 13 may be used both for controlling the light-emitting diodes 122 at the first illumination body and for controlling the second light-emitting diodes 204 at the second illumination body 200. It is also possible to control multiple room lamps. For this purpose, two separate user interfaces may be used.

Figure 14:
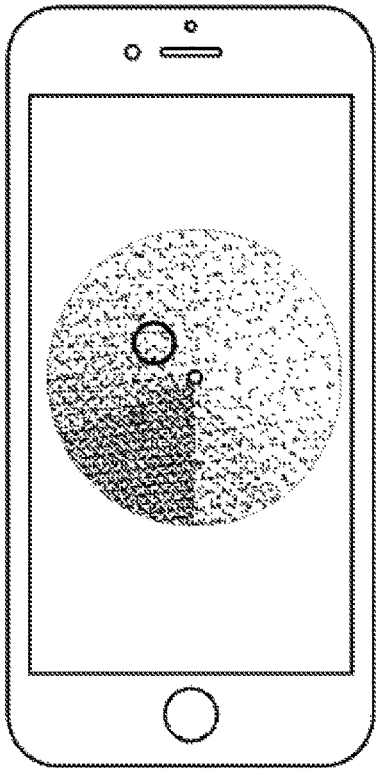
FIG. 14 shows an exemplary user interface for selecting a color temperature and the color of the light output.

Reference is made to FIG. 14 showing a user interface of a touch-sensitive screen on which various colors and color temperatures are shown. The user may change the light output and/or the color of the light which is emitted by the room lamp by touching a desired color temperature or a desired color.

The room lamp comprises a transmission and receiving device 192 (see FIG. 1) with which the information of the portions to be illuminated, the color temperature and/or the color output are received. Further, the orientation of the operating device with the interface for controlling the light output is transmitted.

The orientation determining device of the mobile electronic device may be a compass.

The room lamp comprises an orientation determining device 194, for example a compass. In one embodiment of the receiving device 192, due to signals of the orientation determining device 194 and the orientation of the electronic device transmitted by the mobile electronic device, the receiving device 192 may transform the data via the portions to be illuminated into the coordinate system of the room lamp and select the corresponding light emitting diodes.

In another embodiment the room lamp transmits the orientation of the room lamp 200 to the mobile electronic device via the transmission and receiving device 302. The mobile electronic device adapts a representation of the portion to be illuminated with respect to the transmitted orientation.

The data transmission may occur by using an IP-network, a Bluetooth or optional other network (NFC, Near Field Communication; Communication over a short distance).

If multiple room lamps are used in a room, additional information about the transmission time of radio signals may be determined, for example also the orientation and/or the position of the mobile electronic device.

Figure 15:
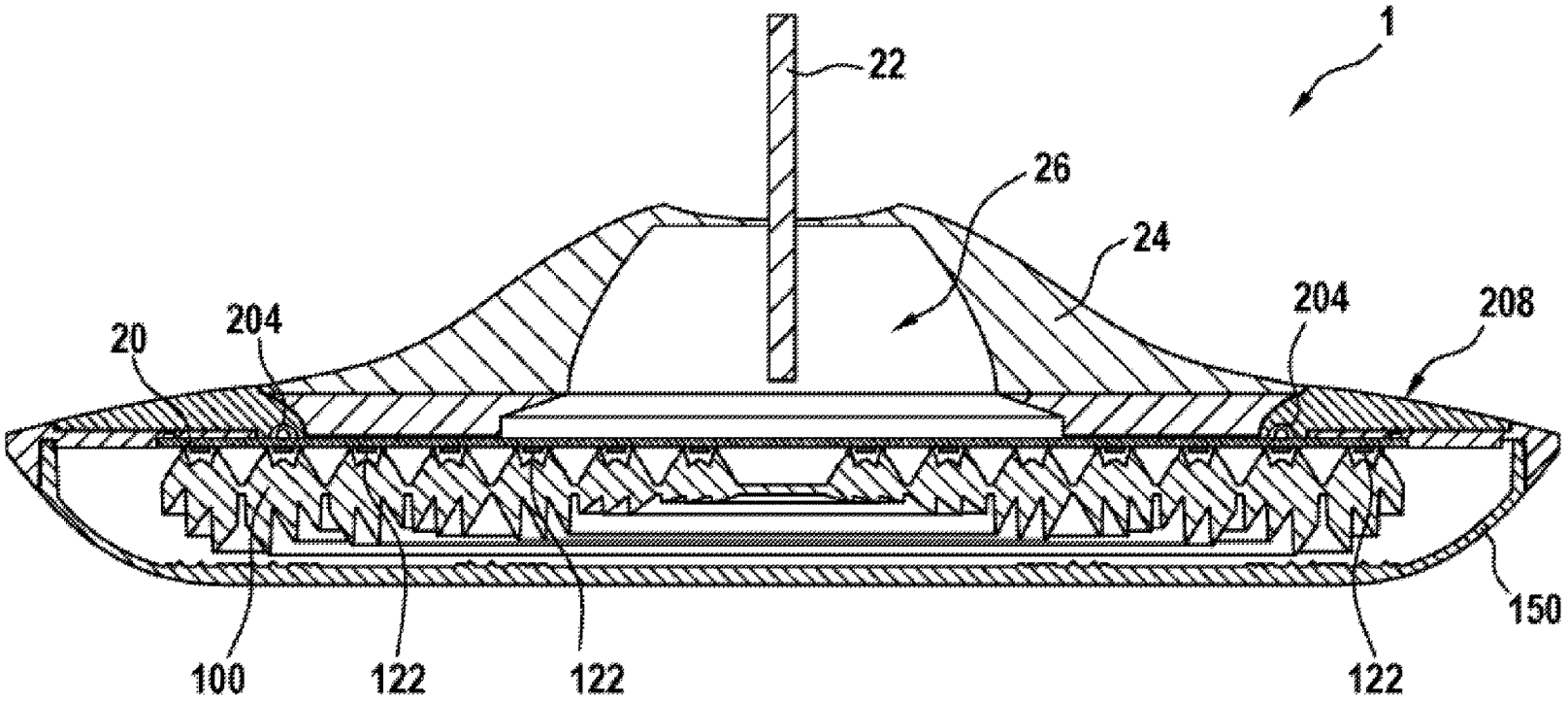
FIG. 15 shows a cross sectional view of a room lamp according to the present invention.

FIG. 15 shows a sectional view of room lamp 1 according to the present invention. The room lamp is secured to the ceiling by a cable 22. It is to be understood that the room lamp may be secured to any other lamp stand. At a circuit board 20 the first light-emitting diodes 122 are directed downwards and the second light-emitting diodes 204 are directed upwards. The first light-emitting diodes 122 are arranged at the first illumination body 100. The diffuser 150 is arranged below the first illumination body 100. The circular light directing body 208 is arranged above the second light-emitting diodes 104. The transmission and receiving device, the orientation determining device 194 and the control electronics are arranged outside of a capsule 26. A shell with cooling fins 24 is arranged around the capsule 26.

The present invention has the advantage that a compact room lamp with an appealing design may be formed which allows illumination of a room directly via the first illumination bodies, as well as indirectly via the second illumination body for example via the ceiling. Additionally, a user may change a desired angle pattern and a desired illumination strategy in use without mechanically adjusting the room lamp. The illumination strategy may vary depending on the use, for example a different illumination strategy may be used for eating than for watching TV. Furthermore, the color and the color temperature may be changed easily.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A method for controlling a light output of a single room lamp comprising the step of:

receiving an input on a touch-sensitive screen of a portable electronic device indicating which portion of at least one area is to be illuminated, a desired illumination color for the portion and a desired illumination brightness for the portion, the input including a touched area on the touch-sensitive screen that corresponds to the portion of the at least one area to be illuminated;

determining an orientation of the portable electronic device; and transmitting an indication of the size and/or the color and/or the brightness of the portion of the at least one area to be illuminated and the orientation of the portable electronic device to the single room lamp;

controlling the light output of the single room lamp so that the single room lamp illuminates the at least one area according to the input received on the touch-sensitive screen determining an orientation of the single room lamp transmitting the orientation of the single room lap to the portable electronic device; and displaying an indication of the area to be illuminated on the touch-sensitive screen.

2. The method according to claim 1, further comprising the step of determining the portion of the at least one area to be illuminated via a swiping or touching interaction on one corresponding area on the touch-sensitive screen.

3. The method according to claim 1, further comprising the step of rotating a representation of the portion of the area to be illuminated in response to the orientation and/or a change of the orientation of the operating device and/or the room lamp.

4. The method according to claim 1, further comprising the step of determining the area to be illuminated via a swiping or touching interaction on one corresponding area on the touch-sensitive screen.

5. The method according to claim 1, further comprising the step of increasing the brightness of at least one area to be illuminated as a corresponding portion of the touch-sensitive screen is continuously touched.

6. The method according to claim 1, further comprising the step of increasing the brightness of at least on area to be illuminated as the touch-sensitive screen is continuously touched.

7. The method according to claim 1, further comprising the step of increasing the brightness of at least one area to be illuminated as the touch-sensitive screen is touched and/or is swiped over with increased frequency.

8. The method according to claim 1, further comprising the step of switching the single room lamp to full power for a downward illumination and/or for an upward illumination in response to a click or a double-click on an icon on the touch-sensitive screen.

9. The method according to claim 1, further comprising the step of varying a brightness of a downward illumination and/or an upward illumination in response to moving an icon on the touch-sensitive screen.

10. The method according to claim 1, further comprising the step of varying a brightness of a downward illumination and/or an upward illumination in response to a swiping gesture with a finger on the touch-sensitive screen.

11. The method according to claim 1, further comprising the step of varying a brightness of a downward illumination and/or an upward illumination in response to a swiping gesture with two fingers on the touch-sensitive screen.

12. The method according to claim 1, further comprising the step of reducing a brightness of an area to be illuminated after a delete icon on the touch-sensitive screen has been touched, and a swiping gesture over a corresponding area of the touch-sensitive screen has been performed.

13. The method according to claim 1, further comprising the step of reducing a brightness of an area to be illuminated after a delete icon on the touch-sensitive screen has been touched, wherein the brightness of the area to be illuminated is continuously reduced, as a corresponding area of the touch-sensitive screen is continuously touched.

14. The method according to claim 1, further comprising the step of reducing a brightness of an area to be illuminated, after a delete icon on the touch-sensitive screen has been touched, wherein the brightness of the area to be illuminated is reduced at an increasing rate as a corresponding area of the touch-sensitive screen is swiped over with increased speed thereafter.

15. The method according to claim 1, further comprising the step of changing the light output of the single room lamp in at least one area in relation to an external event.

16. The method according to claim 1, further comprising the step of changing the light output of the single room lamp in at least one area in response to a time of day.

17. The method according to claim 1, further comprising the step of changing the light output of the single room lamp in at least one area in response to an external parameter.

* * * * *